US009539848B2

(12) United States Patent
Bez

(10) Patent No.: US 9,539,848 B2
(45) Date of Patent: Jan. 10, 2017

(54) WRITING INSTRUMENT HAVING A MOVABLE PROTECTIVE SLEEVE

(71) Applicant: Societe BIC, Clichy (FR)

(72) Inventor: Arnaud Bez, Garches (FR)

(73) Assignee: SOCIÉTÉ BIC, Clichy (FR)

( * ) Notice: Subject to any disclaimer, the term of this patent is extended or adjusted under 35 U.S.C. 154(b) by 61 days.

(21) Appl. No.: 14/386,359

(22) PCT Filed: Mar. 8, 2013

(86) PCT No.: PCT/FR2013/050493

§ 371 (c)(1),
(2) Date: Sep. 19, 2014

(87) PCT Pub. No.: WO2013/140062

PCT Pub. Date: Sep. 26, 2013

(65) Prior Publication Data

US 2015/0043957 A1 Feb. 12, 2015

(30) Foreign Application Priority Data

Mar. 20, 2012 (FR) ..... 12 52481

(51) Int. Cl.

| | |
|---|---|
| ***B43K 5/16*** | (2006.01) |
| ***B43K 24/06*** | (2006.01) |
| ***B43K 7/12*** | (2006.01) |
| ***B43K 8/00*** | (2006.01) |
| ***B43K 23/12*** | (2006.01) |
| ***B43K 24/02*** | (2006.01) |
| ***B43K 5/00*** | (2006.01) |
| ***B43K 7/00*** | (2006.01) |

(52) U.S. Cl.

CPC ..... *B43K 24/06* (2013.01); *B43K 5/005* (2013.01); *B43K 7/005* (2013.01); *B43K 7/12* (2013.01); *B43K 8/003* (2013.01); *B43K 23/12* (2013.01); *B43K 24/026* (2013.01); *B43K 5/16* (2013.01)

(58) Field of Classification Search

CPC ..... B43K 5/16; B43K 24/026
USPC ..... 401/116, 117, 234
See application file for complete search history.

(56) References Cited

U.S. PATENT DOCUMENTS

| | | | | |
|---|---|---|---|---|
| 866,148 | A * | 9/1907 | Levingston | 401/91 |
| 2,941,511 | A | 6/1960 | Cieremans | |
| 3,288,116 | A * | 11/1966 | Poritz | 401/29 |
| 4,529,328 | A * | 7/1985 | Wacha et al. | 401/117 |
| 4,780,016 | A | 10/1988 | Kim | |
| 8,079,767 | B2 | 12/2011 | Rolion et al. | |

(Continued)

FOREIGN PATENT DOCUMENTS

| | | |
|---|---|---|
| EP | 1 645 435 A2 | 4/2006 |
| WO | WO 2008/040912 A2 | 4/2008 |

*Primary Examiner* — David Walczak
*Assistant Examiner* — Joshua Wiljanen
(74) *Attorney, Agent, or Firm* — Polsinelli

(57) ABSTRACT

A writing instrument that includes a barrel extending along a longitudinal axis (A) and a tip mounted at the front of the barrel, further including a protective sleeve for the tip, the sleeve being mounted coaxially on the barrel and movable relative to the barrel between a protective position where it covers the tip and a retracted position where it exposes the tip to allow writing. The sleeve includes an inner wall which includes a helical cam engaging with a guide element formed on the barrel so that the sleeve is movable in translation combined with rotation.

20 Claims, 4 Drawing Sheets

(56) References Cited

U.S. PATENT DOCUMENTS

Figure 16:
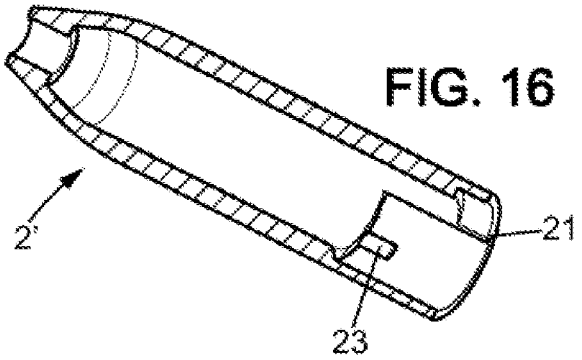

| | | | | |
|---|---|---|---|---|
| 8,641,308 | B2 * | 2/2014 | Peyton et al. | 401/117 |
| 2006/0115314 | A1 | 6/2006 | Salvadori | |
| 2007/0020024 | A1 | 1/2007 | Tsai | |
| 2010/0074670 | A1 * | 3/2010 | Rolion | 401/68 |

* cited by examiner

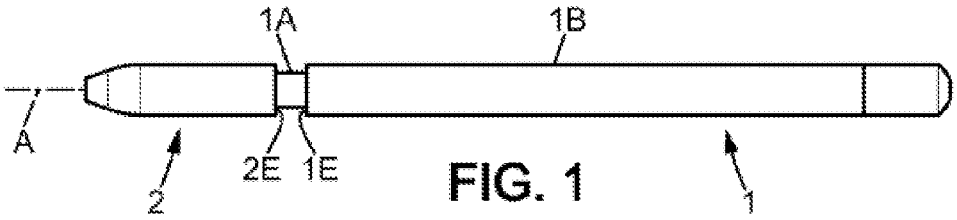
FIG. 1
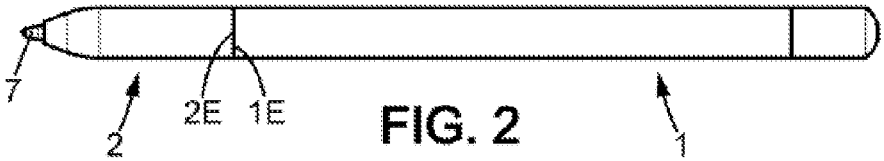
FIG. 2
FIG. 3
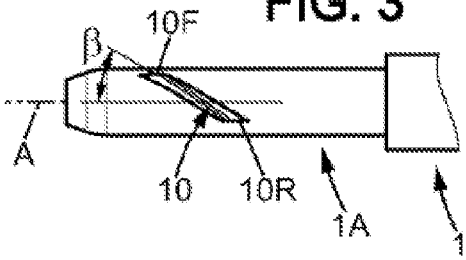
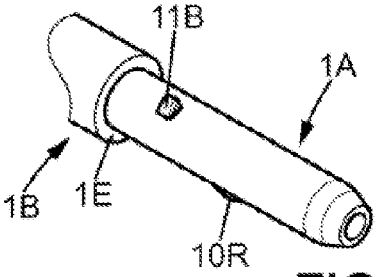
FIG. 4
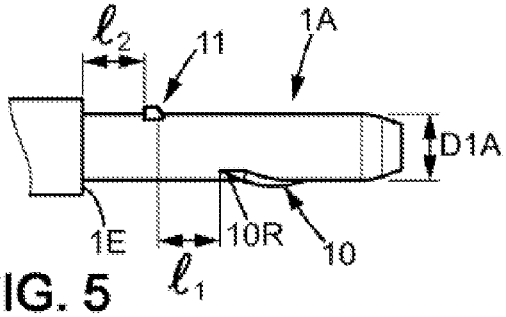
FIG. 5
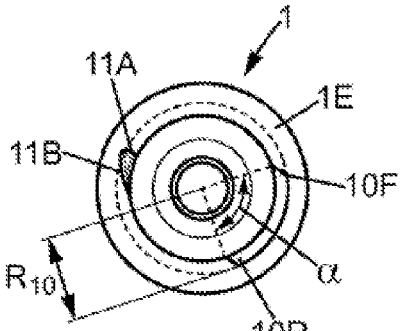
FIG. 6

FIG. 7
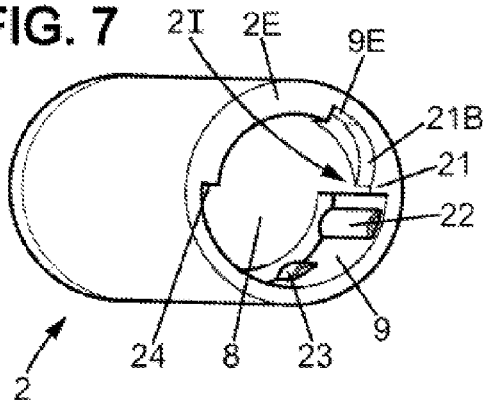
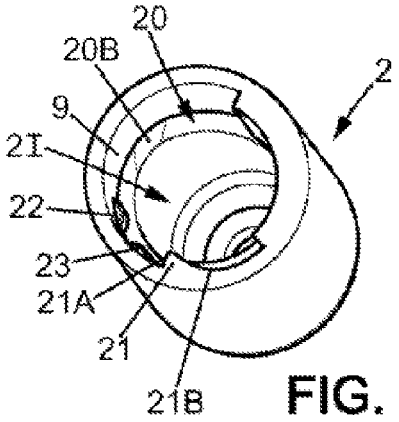
FIG. 8
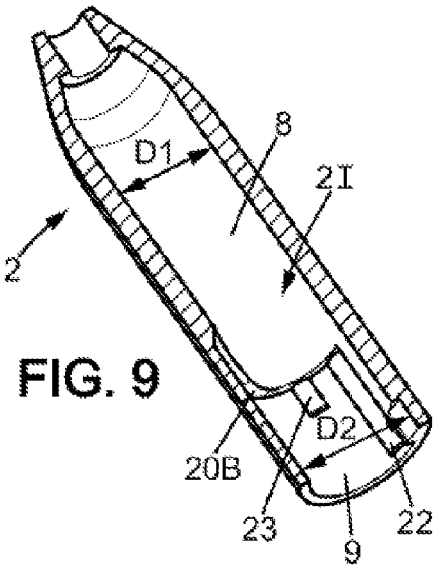
FIG. 9
FIG. 10
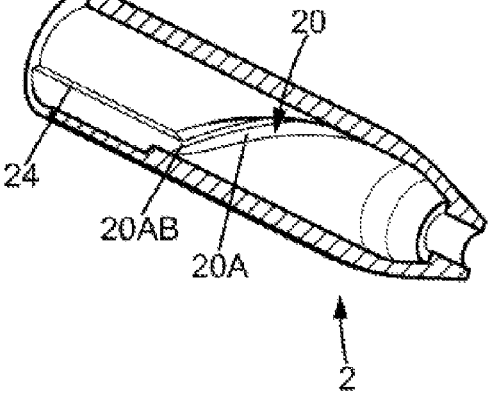
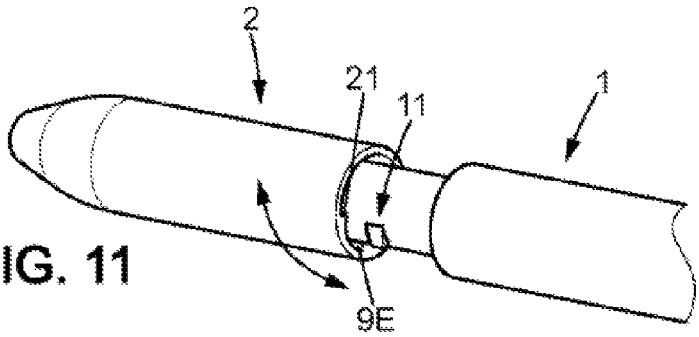
FIG. 11

FIG. 12
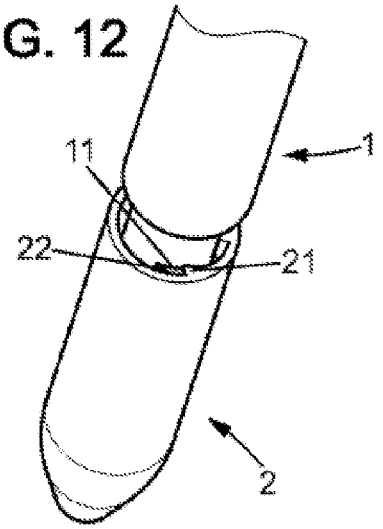
FIG. 13
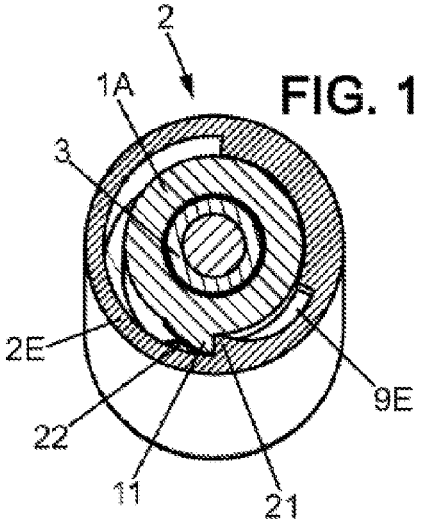
FIG. 14
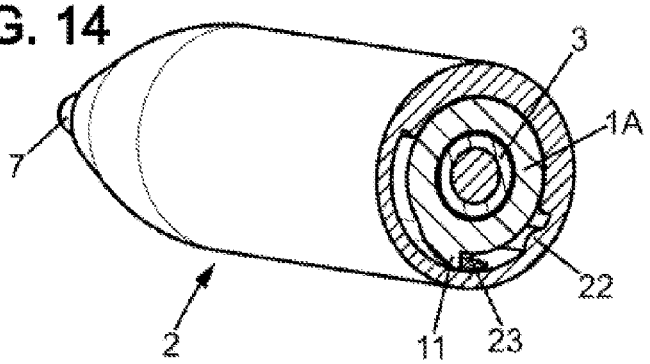
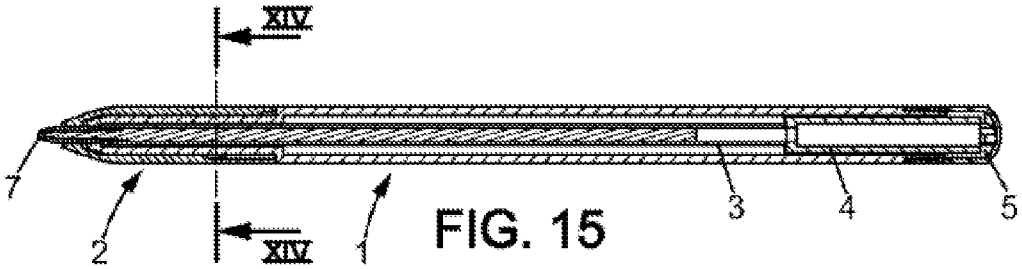
FIG. 15

WRITING INSTRUMENT HAVING A MOVABLE PROTECTIVE SLEEVE

CROSS REFERENCE TO RELATED APPLICATIONS

This application is a national stage application of International Application No. PCT/FR2013/050493, filed on Mar. 8, 2013, which claims the benefit of French Patent Application No. 1252481, filed on Mar. 20, 2012, the entire contents of both applications being incorporated herein by reference.

BACKGROUND OF THE INVENTION

Field of the Invention

The embodiments of the present invention relate to a writing instrument comprising a barrel extending along a longitudinal axis and a tip mounted at the front of the barrel, further comprising a protective sleeve for the tip, said sleeve being mounted coaxially on the barrel and movable in translation relative to the barrel between a protective position where it covers the tip and a retracted position where it exposes the tip to allow writing, said sleeve having an inner wall which comprises a helical cam engaging with a guide element formed on the barrel so that the sleeve is movable in translation combined with rotation, said sleeve further comprising on its inner wall a detent element capable of engaging with a retaining element formed on the barrel so as to prevent the sleeve from being detached from the barrel.

Description of Related Art

Such a writing instrument is known from U.S. Pat. No. 2,941,511. The barrel comprises a guide element formed by a screw thread, and the guiding helical cam on the inner wall of the sleeve is formed by a helical groove which engages the thread. The retaining element of the barrel is formed by an annular collar of frustoconical shape, and the detent element of the sleeve is formed by an annular flange projecting inwardly at the rear end of the inner wall of the sleeve. The annular collar has an outside diameter slightly greater than the inside diameter of the annular flange, and the sleeve has a resilience adapted so that the inside diameter of the annular flange can increase to allow passing over the annular collar when force fitting the sleeve onto the barrel. In the tip protection position, the helical groove of the sleeve is disengaged from the screw thread of the barrel, so that an inner shoulder of the sleeve abuts against the thread and prevents the sleeve from retracting when pressed upon. The sleeve can then rotate freely without causing a translational movement, but a position is necessarily provided where the screw thread again engages with the helical groove to allow screwing the sleeve onto the barrel.

This known writing instrument offers the advantage of a reliable guide for the movement of the sleeve on the barrel, because of the conventional solution of a screw thread engaged in a helical groove. As these elements are designed to be inflexible and rigid enough not to deform, there is virtually no risk that the thread will come out of the groove, particularly in the case where the user continues to exert a screwing force on the sleeve when it is in the retracted position, or in other words when the tip is exposed. In comparison, other known writing instruments with movable protective sleeves use at least one guide element consisting of a radially flexible element engaged in a helical slot that is closed at both ends. There is then a risk that because of its flexibility, a guide element comes out of the slot when excessive force is exerted on the sleeve, which detaches the protective sleeve from the barrel. Another advantage of the writing instrument known from U.S. Pat. No. 2,941,511 is that it does not require a through-slot in the wall of the sleeve, which can be advantageous for example if creating a molded grip on the outer surface of the sleeve.

This writing instrument has various drawbacks, however. In particular, in the tip protection position, the sleeve is not securely locked because it can rotate freely which allows accidental engagement of the screw thread with the helical groove and consequently screwing the sleeve on the barrel. This phenomenon can occur when the instrument is stored in a pocket and subjected to random stresses. Accidental retraction of the sleeve could result in stained clothing since the tip is no longer protected. Furthermore, as the sleeve is not rotationally locked when in the tip protection position, it does not feel sturdy to the user. In addition, intentionally screwing the sleeve from its protective position takes time, since the user must first gently rotate the sleeve to a position where the thread engages with the groove.

The invention aims in particular to resolve the above drawbacks, by providing a firm and reliable locking of the sleeve in the tip protection position, while guiding the movement of the sleeve on the barrel with no risk of the guide element disengaging from the helical cam and while not requiring a through-slot in the sleeve wall.

To this end, the embodiments of the present invention relates to a writing instrument as defined above, characterized in that it comprises a locking element capable of engaging with one among said retaining element and said detent element so as to lock said protective position.

With these arrangements, the protective position is locked so that the sleeve is immobilized in translation and in rotation relative to the barrel, with no risk of accidentally leaving its position. Furthermore, since the locking element engages one among the retaining element and detent element which between them snap-fit the sleeve on the barrel during mounting, this implies that the retaining element or detent element provides both a sleeve snap-fitting function and a sleeve locking function in the protective position. It is thus not necessary to provide a specific element distinct from the retaining element and detent element to cooperate with the locking element, which simplifies the molding of the sleeve or barrel.

In preferred embodiments of a writing instrument according to the embodiments of the present invention, use is made of one or more of the following arrangements, possibly in combination:

The locking element is formed on the inner wall of the sleeve, preferably in the immediate vicinity of the detent element, and is capable of engaging with the retaining element;

The locking element is formed on the barrel, preferably in the immediate vicinity of the retaining element, and is capable of engaging with the detent element;

the detent element extends in a circumferential direction of the sleeve, forming a detent tooth having an apex as well as a first face and a second face arranged on each side of said apex, said first face extending locally substantially perpendicular to a cylindrical surface of the inner wall of the sleeve and forming a detent tooth stop which engages with the retaining element in said protective position; thereby facilitating the snap-fitting of the sleeve onto the barrel, allowing an elastic deformation of the sleeve in the radial direction which is primarily localized to the detent tooth and in addition allows irreversible latching without compromising the ease of assembly, unlike the device known from U.S. Pat.

No. 2,941,511 in which the sleeve must be radially deformed along its entire circumference in order to be snap-fitted onto the barrel;

the retaining element extends in a circumferential direction of the barrel, forming a retaining tooth which has an apex as well as a first face and a second face, arranged on each side of said apex, said first side extending locally substantially perpendicular to an outer cylindrical surface of the barrel and forming an abutment that engages with said detent tooth stop in said protective position; whereby the snap fit is more securely irreversible;

the guide element of the barrel is formed by a helical rib extending circumferentially relative to the barrel axis over an angle of less than 170°, and the helical cam of the sleeve comprises a helical groove with which said helical rib engages; thereby facilitating the molding of the guide element integral with the barrel;

said angle over which the helical rib extends circumferentially is between 60° and 120°, and said helical rib forms with the barrel axis a pitch angle of between 20° and 50°; thereby allowing a rotation of the sleeve of less than a half-turn and preferably about a quarter-turn to be sufficient to move the sleeve from the protective position to the retracted position, thus facilitating manipulation by the user;

the retaining element has an angular position with respect to the barrel axis that is substantially opposite the average angular position of the guide element, and has an axial position that is offset towards the rear of the barrel with respect to said guide element;

the inner wall of the sleeve comprises a first wall portion in which is formed at least a portion of the helical cam and generally having a first diameter, and comprises a second wall portion generally having a second diameter larger than said first diameter; which is advantageous for providing a sufficiently high guide element for the strength of the guide, as well as a sleeve of relatively small diameter while having a wall that is generally fairly thick to ensure the overall stiffness of the sleeve;

the locking element s formed on said second wall portion immediately adjacent to the detent element; thereby facilitating the local radial deformation of the sleeve at the detent element and locking element and so facilitating engagement with the retaining element; the guide element and retaining element are formed on a front portion of the barrel forming a generally cylindrical tube having an outside diameter substantially equal to said first diameter, and the guide element has an outer radius substantially equal to half said second diameter; which is advantageous for ensuring proper axial alignment of the sleeve with the barrel;

a second locking element is formed by a second protuberance placed on said second wall portion and arranged to lock the retracted position of the sleeve; thereby preventing the sleeve from leaving the retracted position while the user is writing;

each of said first and second protuberances have a cylindrical shape that is truncated in its axial direction, said axial direction being parallel to the longitudinal axis of the sleeve; thereby facilitating unmolding of the sleeve during manufacture.

Other features and advantages will be apparent from the following description of some non-limiting exemplary embodiments, with reference to the figures in which:

FIG. 1 schematically represents a side view of a writing instrument according to the invention, with the sleeve in the protective position for protecting the writing tip.

FIG. 2 schematically represents a side view of the writing instrument of FIG. 1, with the sleeve in the retracted position to enable writing.

FIG. 3 schematically represents a partial side view of a front portion of the barrel of a first embodiment of the writing instrument of FIG. 1.

FIG. 4 schematically represents a partial perspective view of the front portion of the barrel represented in FIG. 3.

FIG. 5 schematically represents another side view of the front portion of the barrel represented in FIG. 3.

FIG. 6 schematically represents a front view, along the axis of the writing instrument, of the front portion of the barrel represented in FIG. 3.

FIG. 7 schematically represents a perspective view of the protective sleeve of the first embodiment of the writing instrument of FIG. 1.

FIG. 8 schematically represents another perspective view of the protective sleeve of FIG. 7.

FIG. 9 schematically represents a perspective cutaway view of the protective sleeve of FIG. 7.

FIG. 10 schematically represents another perspective cutaway view of the protective sleeve of FIG. 7.

FIG. 11 schematically represents a partial perspective view of the first embodiment of the writing instrument of FIG. 1, with the protective sleeve in a mounting position.

FIG. 12 schematically represents a partial perspective view of the first embodiment of the writing instrument of FIG. 1, with the sleeve in the protective position.

FIG. 13 schematically represents a partial cutaway perspective view of the first embodiment of the writing instrument of FIG. 1, with the sleeve in the protective position.

FIG. 14 schematically represents a partial cutaway perspective view of the first embodiment of the writing instrument of FIG. 1, with the sleeve in the retracted position.

FIG. 15 schematically represents a longitudinal sectional view of the first embodiment of the writing instrument with the sleeve in the retracted position as represented in FIG. 2.

FIG. 16 schematically represents a cutaway perspective view of the protective sleeve of a second embodiment of the writing instrument of FIG. 1.

Figure 17:
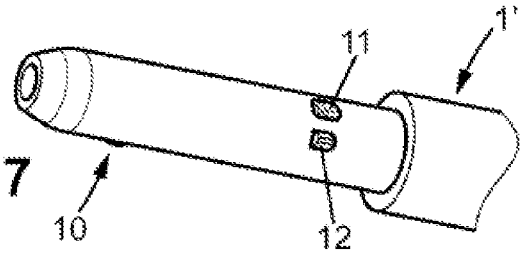

FIG. 17 schematically represents a partial perspective view of the front portion of the barrel of the second embodiment of the writing instrument.

Figure 18:
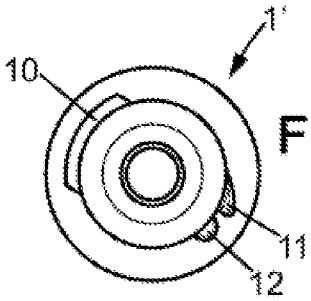

FIG. 18 schematically represents a front view, along the axis of the writing instrument, of the front portion of the barrel represented in FIG. 17.

Figure 19:
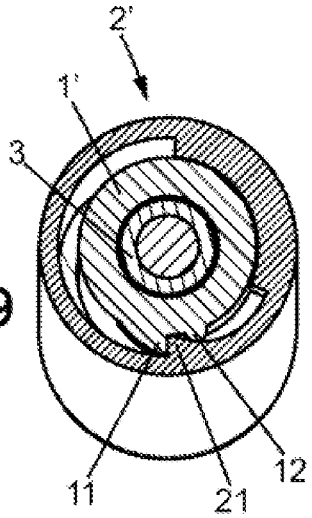

FIG. 19 schematically represents a partial cutaway perspective view of the second embodiment of the writing instrument, with the sleeve in the protective position.

The writing instrument represented in FIG. 1 and FIG. 2 has a barrel 1 which extends along a longitudinal axis A. The barrel 1 comprises a front portion 1A generally forming a cylindrical tube, and a main cylindrical tubular portion 1B of larger outside diameter than the front portion 1A, which form an annular shoulder 1E where they join. A protective sleeve 2, visible in detail in FIGS. 7 to 10, is mounted to allow its helical movement on the front portion 1A of the barrel, coaxially to the barrel 1. The sleeve 2 is movable between a protective position (FIG. 1) where it covers a writing tip 7 in order to protect it, and a retracted position (FIG. 2) where it exposes the tip 7 to enable writing.

In its refracted position, the sleeve 2 abuts against the annular shoulder 1E of the barrel. Advantageously, the sleeve 2 has a rear end edge 2E forming a flat surface which comes in full contact with the annular shoulder 1E which also forms a flat surface. In addition, the sleeve 2 has an outside diameter equal to that of the main portion 1B of the barrel. In this manner, in the retracted position of the sleeve, the sleeve and barrel form a continuous surface with no gaps where they meet, which is esthetically advantageous and enables the user to hold the instrument comfortably while writing.

In an embodiment of the writing instrument according to the invention which is not represented, a grip may be overmolded onto the outer surface of the sleeve 2. This grip can also cover the flat surface of the rear end edge 2E of the sleeve 2, and thus come into contact with the annular shoulder 1E of the barrel in the retracted position of the sleeve 2.

As represented in FIGS. 3 to 6, in a first embodiment of the writing instrument of FIG. 1, the front portion 1A of the barrel 1 has an outside diameter D1A smaller than the outside diameter of the main portion 1B of the barrel (FIG. 5), and on its outer surface comprises a guide element 10 and a retaining element 11. The guide element 10 is formed by a helical rib extending circumferentially relative to the longitudinal axis A of the barrel over an angle α, for example about 90°, between a front end 10F and a rear end 10R of the rib (FIG. 6).

Advantageously, the angle α is less than 170°, which facilitates molding the outer surface of the barrel 1 with a mold comprising two half-molds, the helical rib 10 then being formed by one half-mold. Even more preferably, the angle α is between 60° and 120°. The helical rib 10 forms with the longitudinal axis A of the barrel a pitch angle β of between 20° and 50° (FIG. 3), so that rotation of the sleeve 2, for example by about 90°, is sufficient to move the sleeve along its entire translational path between the protective position and the retracted position. This arrangement facilitates manipulation by the user, because the transition of the sleeve from one position to the other can be achieved with one quick motion.

The retaining element 11 extends in a circumferential direction of the barrel 1 to form a retaining tooth 11C having an apex 11C as well as a first face 11A and a second face 11B arranged on each side of the apex (FIG. 6). The first face 11A forms a steep side of the tooth, and preferably extends locally substantially perpendicular to an outer cylindrical surface of the front portion 1A of the barrel from which the tooth protrudes. "Locally extends perpendicular to a cylindrical surface" is understood to mean a direction perpendicular to a plane which is tangent to the cylindrical surface, at the local area in question.

For example, the first face 11A extends in a radial plane of said outer cylindrical surface, meaning a plane containing the longitudinal axis A of the barrel, which is the case in the embodiment represented. However, the plane of the extension of the first face 11A is not necessarily radial, and in one embodiment (not shown) the plane may have a certain inclination with respect to the longitudinal axis A of the barrel while remaining substantially perpendicular locally to said outer cylindrical surface of the barrel.

Advantageously, the retaining tooth 11 is positioned relative to the longitudinal axis A in an angular position substantially opposite the average angular position of the helical rib 10, as can be seen in FIG. 6, and has an axial position that is offset towards the rear of the barrel with respect to the rib 10, as can be seen in FIG. 5 where the axial offset is represented by the distance L1.

In addition, the retaining tooth 11 is positioned at a distance L2 from the annular shoulder 1E of the barrel, said distance L2 preferably being equal to the translational travel of the sleeve 2 between the protective position and the retracted position. The helical rib 10 has an outer radius R10. Advantageously, the retaining tooth 11 has the same height as the rib 10, meaning that its apex lies on a circle of radius R10 (FIG. 6).

As represented in FIGS. 7 to 9, in the first embodiment of the writing instrument of FIG. 1, the protective sleeve 2 has an inner wall 2I which comprises a helical cam 20. This helical cam comprises in particular a helical groove 20A formed in a first wall portion 8 of the inner wall 2I of the sleeve (FIG. 9, FIG. 10). The helical rib 10 of the barrel is adapted to engage with the helical groove 20A, so that translation of the sleeve is combined with rotation of the sleeve.

The sleeve 2 further comprises a detent element 21 on its inner wall 2I, adapted to pass over a retaining element 11 of the barrel and thus snap-fit the sleeve onto the barrel during assembly to prevent the sleeve from separating from the barrel.

The passage of the two elements over one another is possible due to the capacity of the sleeve for a certain elastic deformation in the radial direction. The plastic material used for the sleeve, and the structure and thickness of the sleeve walls, are parameters to be taken into account to achieve sufficient elastic deformation of the sleeve for the desired snap-fit.

Advantageously, the detent element 21 extends in a circumferential direction of the sleeve 2, forming a detent tooth. With this arrangement, when the detent tooth 21 passes over the retaining tooth 11 of the barrel during assembly, the elastic deformation of the sleeve in the radial direction is mainly localized at the detent tooth, which facilitates the snap-on assembly of the sleeve onto the barrel. Even more preferably, the detent tooth 21 has an apex 21C as well as a first face 21A and a second face 21B arranged on each side of the apex. The first face 21A forms a steep side of the tooth, and preferably extends locally substantially perpendicular to a cylindrical surface of the inner wall 2I of the sleeve.

This first face 21A forms a stop for the detent tooth 21 which, in the protective position of the sleeve, cooperates with the abutment formed by the first face 11A of the retaining element 11 For example, the first face 21A extends in a radial plane of said cylindrical surface of the inner wall 2I, meaning a plane containing the longitudinal axis of the sleeve, which is the case in the embodiment represented. However, the plane of the extension of the first face 21A is not necessarily radial, and in one embodiment (not shown) the plane may have a certain inclination with respect to the longitudinal axis. The second face 11B of the retaining tooth 11 and the second face 21B of the detent tooth do not form steep sides of the teeth, but sides that slope for example at an angle of less than 45° locally with respect to a cylindrical surface of the front portion 1A of the barrel or of the inner wall of the sleeve. In this manner, the second face 21B of the detent tooth 21 is designed to exert pressure on the second face 11B of the retaining tooth 11 during assembly in order to radially deform the sleeve and/or barrel, until the detent tooth 21 passes beyond the retaining tooth 11 to snap-fit the sleeve 2 on the barrel 1 in the protective position of the sleeve, as explained below with reference to FIG. 12 and FIG. 13.

The first wall portion 8 of the inner wall 2I of the sleeve, in which the groove 20A is formed, generally has a first diameter D1 more or less equal to the outside diameter D1A of the front portion 1A of the barrel 1, so that the sleeve 2 can slide coaxially on the front portion 1A of the barrel. Considering manufacturing tolerances, in practice it is arranged so that D1 is slightly greater than D1A. The inner wall 2I of the sleeve comprises a second wall portion 9 generally having a second diameter D2 greater than the first diameter D1 (FIG. 9). This second wall portion 9 serves in particular to position the helical rib 10 of the barrel in the sleeve 2 during assembly, since the second diameter D2 is slightly greater than twice the outside radius R10 of the helical rib 10. In addition, the smaller radial thickness of this wall portion 9 serves to provide areas of the sleeve that facilitate elastic deformation in the radial direction. A first locking element 22 is formed on the second wall portion 9 of the sleeve and is located immediately adjacent to the detent element 21, provided for cooperating with the retaining element 11 so as to lock the protective position. The locking in position can be more or less strong, to prevent accidental retraction of the sleeve 2 but without making it difficult for the user to complete the sleeve screwing motion and expose the tip 7. It is understood that the shape and height of the first locking element 22 affect the strength of the locking in the protective position.

The first locking element 22 is, for example, formed by a first protuberance having a cylindrical shape truncated in its axial direction, for example a half-cylinder shape. The axial direction of the protuberance is parallel to the longitudinal axis A of the sleeve. The rounded form of the protuberance is advantageous so that the protuberance can pass over the retaining element 11 of the barrel in both directions of rotation of the sleeve 2 and without excessive resistance. The first protuberance 22 is arranged to come in contact with the second face 11B of the retaining tooth 11 in the protective position of the sleeve, as is particularly visible in FIG. 13. In this manner, the locking of the sleeve in the protective position can be relatively strong, meaning that screwing the sleeve from its protective position requires an initial screwing force sufficient to elastically deform the sleeve and/or barrel so that the first protuberance 22 passes over the retaining element 11.

Advantageously, a second locking element 23 is formed by a second protuberance arranged on the second wall portion 9 of the sleeve so as to lock the sleeve in the retracted position. The second protuberance 23 has, for example, a truncated cylindrical shape similar to that of the first protuberance 22, so as to cooperate in a similar manner with the retaining element 11. This cylindrical shape similarly extends advantageously in an axial direction parallel to the longitudinal axis of the sleeve. These arrangements facilitate molding the sleeve during manufacture. It is understood that the two protuberances 22 and 23 and the detent tooth 21 may be formed using a single central spindle which is removed along the longitudinal axis of the sleeve during unmolding. The second protuberance 23 is located towards the front of the sleeve relative to the first protuberance 22, on the helical path that the retaining element 11 follows relative to the wall portion 9 of the sleeve.

Other solutions for locking the sleeve in the retracted position are possible without providing such a second protuberance 23. For example, the first protuberance 22 could be extended axially slightly beyond the rear end edge 2E of the sleeve, to form a projection adapted to cooperate with a corresponding detent notch formed on the barrel at the annular shoulder 1E of the barrel.

The first wall portion 8 and the second wall portion 9 of the sleeve join by forming a rectilinear shoulder area 24 which extends parallel to the longitudinal axis A of the sleeve, as well as a helical shoulder area 20B located in the extension of the helical groove 20A and which forms a ramp portion of the helical cam 20. The helical shoulder area 20B is arranged so as to position the helical rib 10 which comes in contact with said area 20B in a mounting position of the sleeve (FIG. 11), such that the front end 10F of the helical rib is facing an entrance 20AB to the helical groove 20A (FIG. 10). The rectilinear shoulder area 24 also serves to guide the front end 10F of the helical rib to the entrance 20AB to the groove.

Advantageously, the second face 21B of the detent tooth 21 is joined at its base to an end portion 9E of the second wall portion 9 of the sleeve (FIG. 7). This arrangement improves the elastic deformation of the sleeve 2 at the detent tooth 21, which therefore facilitates snap-fitting the sleeve on the barrel during assembly. As represented in FIG. 11, where the sleeve is in the mounting position, the retaining element 11 of the barrel is arranged to be positioned substantially in the same angular position as the end portion 9E of said aforementioned second wall portion 9. As mentioned above, the helical rib 10 is then in contact with the ramp portion 20B of the helical cam 20 and is ready to be engaged with the helical groove 20A. In this manner, pressure exerted on the front of the sleeve 2 causes the front 10F of the helical rib 10 to engage with the entrance 20AB to the helical groove 20A, which initially causes the sleeve to screw onto the barrel with virtually no resistance until the detent element 21 comes in contact with the retaining element 11. Greater effort is then needed to snap the sleeve onto the barrel, or in other words for the detent element 21 to pass beyond the retaining element 11 and bring the sleeve into its protective position as shown in FIG. 12 and FIG. 13.

It is especially apparent in FIG. 13 that the steep side of the detent tooth 21, meaning the first face 21A visible in FIG. 8, forms a detent stop which cooperates with the steep side of the retaining tooth 11 to make the locking of the sleeve on the barrel irreversible. Indeed, the first faces of the two teeth each extend in a radial plane of the sleeve, said plane containing the longitudinal axis A of the barrel. Mutual pressure between the first faces of the teeth therefore produces stresses exerted only in the circumferential direction of the sleeve, which does not cause any radial deformation of the sleeve. As a result, there is no risk of the user separating the sleeve from the barrel when unscrewing the sleeve to protect the tip. The unscrewing force required to break the detent would not be achievable during normal use of the writing instrument.

As is particularly visible in FIG. 13, the locking element 22 being in the immediate vicinity of the detent element 21 allows the retaining tooth 11 to be in contact with each of the aforementioned elements 21 and 22 in the protective position of the sleeve, avoiding play during movement to help stabilize the protective position. Furthermore, as shown in FIG. 12 and in FIG. 13, the retaining tooth 11 has a rear face to provide surface continuity with the flat rear end edge 2E of the sleeve 2 in the protective position of the sleeve, which is particularly advantageous in terms of aesthetics.

In the protective position of the sleeve, the helical rib 10 is partially engaged in the helical groove 20A. If the user rotates the sleeve 2, for example in the conventional screwing-in direction for the embodiment shown and with sufficient force for the first locking element 22 to pass beyond the retaining tooth 11, the sleeve advances towards the barrel until the second locking element 23 comes in contact with the sloped side of the retaining tooth 11, meaning the second face of the tooth, where the user will feel some resistance to screwing. The rear end edge 2E of the sleeve is then very close to the annular shoulder 1E of the barrel. Continuing the screwing motion with sufficient force allows the second locking element 23 to pass beyond the retaining tooth 11, which can be arranged to coincide with the rear end edge 2E of the sleeve coming in contact with the annular shoulder 1E of the barrel. As represented in FIG. 14, the sleeve is then in its retracted position. Advantageously, the second locking element 23 remains in contact with the retaining tooth 11 in order to reinforce the stability of the retracted position. The strength of the locking in this position is such that the position cannot be unlocked when the user writes with normal pressure on the writing tip 7. In effect, if the user writes while holding the instrument only by the sleeve 2, the retracted position of the sleeve can become unlocked if pressure exceeding that of normal use is exerted on the tip. This unlocking causes a relative displacement of the tip to enter the sleeve.

As represented in FIG. 15, in the embodiment of the writing instrument described in the foregoing, the writing tip 7 is fixedly mounted at the front of a reservoir tube of ink 3 held stationary in the barrel 1. In particular, the reservoir tube 3 is mounted in abutment against a conical end portion of the front portion 1A of the barrel. Advantageously, a rear cap 5 is screw-mounted at the rear of the barrel, and a supporting spacer 4 is mounted in the barrel between the rear cap 5 and the rear of the reservoir tube 3 to keep the tube stationary. Replacement of the cartridge formed by the reservoir tube 3 and tip 7 is possible by taking off the rear cap 5 and removing the support spacer 4.

In a second embodiment with reference to FIGS. 16 to 19, the locking element is formed on the barrel and not on the sleeve. As represented in FIG. 17 and FIG. 18, the locking element may be formed by a protuberance 12 located in the immediate vicinity of a tooth 11 constituting the retaining element. In this second embodiment, barrel 1' differs from barrel 1 described above with reference to FIGS. 3 to 6 solely in the addition of the protuberance 12.

Advantageously, the locking protuberance 12 has a generally rounded shape, for example semi-cylindrical. It is positioned facing the steep side of the retaining tooth 11 in the circumferential direction, and its height is preferably less than the height of the tooth 11. In this manner, the protuberance 12 is able to pass beyond the detent element 21 of the sleeve 2' represented in FIG. 16, in both directions of rotation of the sleeve, unlike the retaining tooth 11 which in the same manner as in the first embodiment cannot pass back over the detent element 21 once assembled.

The locking protuberance 12 cooperates with the detent tooth 21 to lock the protective position as represented in FIG. 25 19. In this position, the detent tooth 21 is arranged between the retaining tooth 11 and the locking protuberance 12 and preferably remains in contact with these projecting elements 11 and 12 to stabilize the position. To unlock the protective position, the user must initiate rotation of the sleeve with sufficient force for the locking protuberance 12 to pass beyond the detent tooth 21. It is understood from the foregoing that the locking protuberance 12 is functionally equivalent to the first locking protuberance 22 in the first embodiment, and therefore fulfills an identical locking function in the same protective position of the sleeve.

Therefore, a first locking element 22 is not necessarily useful in the protective sleeve 2' of the second embodiment. As represented in FIG. 16, the sleeve 2' comprises a single locking protuberance 23, for example identical to the second locking element 23 of the first embodiment, so as to lock the sleeve in the retracted position. In this retracted position, it can be arranged so that locking protuberance 23 is held between the retaining tooth 11 and locking protuberance 12. In the embodiment shown, sleeve 2' differs from sleeve 2 described above with reference to FIGS. 7 to 10 only in the elimination of the first locking element 22.

However, it is understood that sleeve 2' may be identical to the previously described sleeve 2, meaning that it can keep the first locking element 22, without incompatibility with the second embodiment described above. This variant of the aforementioned second embodiment of the invention can be useful when wanting to further reinforce the locking of the sleeve in the protective position. Indeed, from the representation in FIG. 19, it is understood that the addition of a locking protuberance 22 as can be seen in FIG. 13 has the effect of increasing the user effort required to rotate the sleeve so that not only does the locking protuberance 12 formed on the barrel pass over the detent tooth 21 formed on the sleeve, but also the locking protuberance 22 formed on the sleeve passes over the retaining tooth 11 formed on the barrel.

The two locking protuberances 12 and 22 may advantageously be designed to avoid or nearly avoid contact with each other during movement of the sleeve between its protective position and retracted position. For example, the height of each locking protuberance 12 or 22 in the radial direction may be less than or equal to half the height of the tooth 11 in the radial direction. In this manner, one protuberance 12 or 22 does not travel over the other protuberance 12 or 22 during rotation of the sleeve, or only barely touches the other, which generates no additional resistance corresponding to the pressing of protuberance 12 on protuberance 22. A user turning the sleeve to lock it in the protective position only perceives one point of resistance to be overcome before completing the rotation to lock the sleeve.

In one embodiment (not represented) of the writing instrument of the invention, compatible with all embodiments described herein, a fixed writing tip may be provided that can withdraw slightly towards the inside of the barrel during writing, by means of a damping device which for example allows a small movement of the cartridge within the barrel under the effect of the pressure exerted on the tip. The damping device may, for example, be implemented as a spring mounted between a movable supporting spacer and the rear cap 5.

The foregoing describes a retaining element 11 and a locking element 21 that are formed by teeth which are not inherently flexible radially, meaning that the latching action of these teeth is made possible by local elastic deformation, in the radial direction, of the wall of the sleeve and/or barrel at a tooth. Additionally or alternatively, it is possible to provide that at least one of these teeth is inherently elastically deformable radially, in order to reduce radial deformation stresses on the sleeve and/or barrel during assembly.

For example, a recess can be molded during manufacture, in the form of a notch in the circumferential direction at the base of the steep side of a tooth, so that the tooth forms a flexible tab having a certain elasticity in the radial direction. It is also possible, for example, to provide longitudinal slits in the wall of the front portion of the barrel on either side of the retaining element 11, to obtain greater flexibility of the wall locally at this element.

The invention also relates to a kit for creating the writing instrument of the invention, said kit comprising the barrel (1) and the protective sleeve (2) to be mounted on the barrel, wherein the inner wall (2I) of the sleeve comprises a first wall portion (8) in which is formed at least a portion (20A) of the helical cam (20) and generally having a first diameter (D1), and comprises a second wall portion (9) generally having a second diameter (D2) larger than the first diameter (D1), the guide element (10) of the barrel being arranged facing said second wall portion (9) in a mounting position where the sleeve is engaged on the barrel and ready to be snapped into place thereon.

In preferred embodiments of a kit according to the invention, use is made of one or more of the following arrangements, possibly taken in combination:

the guide element (10) of the barrel is formed by a helical rib, the helical cam (20) of the sleeve comprises a helical groove with which said helical rib engages, said first and second wall portions (8, 9) join to form at least one shoulder area (20B) constituting a ramp portion of the helical cam with which the helical rib comes in contact, such that a front end (10F) of the helical rib is facing an entrance (20AB) to said helical groove in said mounting position of the sleeve; the sleeve is therefore already guided as it moves on the barrel before snapping into place, which facilitates the snap-fitting;

the helical cam (20) of the sleeve engages with the guide element (10) of the barrel to obtain a helical movement of the sleeve relative to the barrel between said mounting position and the protective position of the sleeve;

the retaining element (11) of the barrel and the detent element (21) of the sleeve exert a pressure on one another adapted to deform in a radial direction at least one among the barrel and sleeve between said mounting position and the protective position of the sleeve, so as to snap-fit the sleeve onto the barrel.

The invention claimed is:

1. A writing instrument comprising a barrel extending along a longitudinal axis and a tip mounted at the front of the barrel, further comprising a protective sleeve for the tip, the sleeve being mounted coaxially on the barrel and movable relative to the barrel between a protective position where it covers the tip and a retracted position where it exposes the tip to allow writing, the sleeve having an inner wall which comprises a helical cam engaging with a guide element formed on the barrel so that the sleeve is movable in translation combined with rotation, the sleeve further comprising on its inner wall a detent element capable of engaging with a retaining element formed on the barrel so as to prevent the sleeve from being detached from the barrel, the retaining element forming a retaining tooth having an apex as well as a first face and a second face arranged on each side of the apex, wherein the sleeve comprises a locking element distinct from the detent element and which is capable of engaging with one among the retaining element and the detent element so as to rotationally lock the protective position of the sleeve.

2. The writing instrument according to claim 1, wherein the locking element is formed on the inner wall of the sleeve and is capable of engaging with the retaining element.

3. The writing instrument according to claim 2, wherein the locking element is formed on the barrel and is capable of engaging with the detent element.

4. The writing instrument according to claim 3, wherein the detent element extends in a circumferential direction of the sleeve, forming a detent tooth having an apex as well as a first face and second face arranged on each side of the apex, the first face extending locally substantially perpendicular to a cylindrical surface of the inner wall of the sleeve and forming a detent tooth stop which engages with the retaining element in the protective position.

5. The writing instrument according to claim 4, wherein the retaining element extends in a circumferential direction of the barrel, the first face of the retaining tooth extending locally substantially perpendicular to an outer cylindrical surface of the barrel and forming an abutment that engages with the detent tooth stop in the protective position.

6. The writing instrument according to claim 5, wherein the guide element of the barrel is formed by a helical rib extending circumferentially relative to the barrel axis over an angle of less than 170°, and the helical cam of the sleeve comprises a helical groove with which the helical rib engages.

7. The writing instrument according to claim 6, wherein the angle is between 60° and 120°, and the helical rib forms with the barrel axis a pitch angle of between 20° and 50°.

8. The writing instrument according to claim 7, wherein the retaining element has an angular position with respect to the barrel axis that is substantially opposite the average angular position of the guide element, and has an axial position offset towards the rear of the barrel with respect to the guide element.

9. The writing instrument according to claim 8, wherein the inner wall of the sleeve comprises a first wall portion in which is formed at least a portion of the helical cam and generally having a first diameter, and comprises a second wall portion generally having a second diameter larger than the first diameter.

10. The writing instrument according to claim 9, wherein the locking element is formed on the second wall portion immediately adjacent to the detent element.

11. The writing instrument according to claim 10, wherein the guide element and retaining element are formed on a front portion of the barrel forming a generally cylindrical tube having an outside diameter almost equal to the first diameter, and the guide element has an outer radius almost equal to half the second diameter.

12. The writing instrument according to claim 3, wherein the detent element extends in a circumferential direction of the sleeve, forming a detent tooth having an apex as well as a first face and second face arranged on each side of the apex, the first face extending locally perpendicular to a cylindrical surface of the inner wall of the sleeve and forming a detent tooth stop which engages with the retaining element in the protective position.

13. The writing instrument according to claim 3, wherein the guide element of the barrel is formed by a helical rib extending circumferentially relative to the barrel axis over an angle of less than 170°, and the helical cam of the sleeve comprises a helical groove with which the helical rib engages.

14. The writing instrument according to claim 2, wherein the locking element is formed on the barrel and is capable of engaging with the detent element.

15. The writing instrument according to claim 2, wherein the detent element extends in a circumferential direction of the sleeve, forming a detent tooth having an apex as well as a first face and second face arranged on each side of the apex, the first face extending locally perpendicular to a cylindrical surface of the inner wall of the sleeve and forming a detent tooth stop which engages with the retaining element in the protective position.

16. The writing instrument according to claim 2, wherein the guide element of the barrel is formed by a helical rib extending circumferentially relative to the barrel axis over an angle of less than 170°, and the helical cam of the sleeve comprises a helical groove with which the helical rib engages.

17. A kit comprising a barrel and a protective sleeve to be mounted on the barrel for assembly of a writing instrument comprising a tip mounted at the front of the barrel, the sleeve being adapted to protect the tip and to be coaxially mounted on the barrel and movable relative to the barrel between a protective position where it covers the tip and a retracted position where it exposes the tip to allow writing, the sleeve having an inner wall which comprises a helical cam engaging with a guide element formed on the barrel so that the sleeve once mounted is movable in translation combined with rotation, the sleeve further comprising on its inner wall a detent element capable of engaging with a retaining element formed on the barrel so as to prevent the sleeve from being detached from the barrel, the retaining element forming a retaining tooth having an apex as well as a first face and a second face arranged on each side of the apex, the writing instrument comprising at least one locking element distinct from the detent element and which is capable of engaging with one among the retaining element and detent element so as to rotationally lock the protective position of the sleeve, the inner wall of the sleeve comprising a first wall portion in which is formed at least a portion of the helical cam and generally having a first diameter and further comprising a second wall portion generally having a second diameter larger than the first diameter, the guide element of the barrel being arranged facing the second wall portion in a mounting position of the sleeve where the sleeve is engaged on the barrel and ready to be snapped into place thereon.

18. The kit according to claim 17, wherein the guide element of the barrel is formed by a helical rib, the helical cam of the sleeve comprises a helical groove with which the helical rib engages, the first and second wall portions join to form at least one shoulder area constituting a ramp portion of the helical cam with which the helical rib comes in contact, such that a front end of the helical rib is facing an entrance to the helical groove in the mounting position of the sleeve.

19. The kit according to claim 18, wherein the helical cam of the sleeve engages with the guide element of the barrel to obtain a helical movement of the sleeve relative to the barrel between the mounting position and the protective position of the sleeve.

20. The kit according to claim 19, wherein the retaining element of the barrel and the detent element of the sleeve exert a pressure on one another adapted to deform in a radial direction at least one among the barrel and sleeve between the mounting position and the protective position of the sleeve, so as to snap-fit the sleeve onto the barrel.

* * * * *